US006200436B1

(12) United States Patent
Mei-Chu Woo

(10) Patent No.: US 6,200,436 B1
(45) Date of Patent: Mar. 13, 2001

(54) RECYCLING CONSISTENT PLATING SYSTEM FOR ELECTROPLATING

(75) Inventor: Christy Mei-Chu Woo, Cupertino, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/300,811

(22) Filed: Apr. 27, 1999

(51) Int. Cl.[7] ..... C25B 15/00
(52) U.S. Cl. ..... 204/238; 204/240; 204/276
(58) Field of Search ..... 204/228.6, 232, 204/238, 240, 275.1, 276; 205/101, 123

(56) References Cited

U.S. PATENT DOCUMENTS 3,649,509 * 3/1972 Morawetz et al. ..... 204/238
5,344,491 * 9/1994 Katou ..... 204/238
5,391,285 * 2/1995 Lytle et al. ..... 204/238
6,024,856 * 2/2000 Haydu et al. ..... 204/232

* cited by examiner

*Primary Examiner*—Bruce F. Bell
(74) *Attorney, Agent, or Firm*—Mikio Ishimaru

(57) ABSTRACT

A small plating solution reservoir is used to provide plating of one wafer at a time with a precisely controlled, repeatable, plating solution. The reservoir is connected to basic plating solution and additives which are provided in desired concentrations by a valving and control system for single wafers and the plating solution passes through a filtration unit and is returned to the reservoir during plating or to a plating container after plating. The filtration unit filters particulates and by-products, but also filters additives which a control system replenishes.

20 Claims, 4 Drawing Sheets

RECYCLING CONSISTENT PLATING SYSTEM FOR ELECTROPLATING

CROSS-REFERENCE TO RELATED APPLICATIONS

The present application contains subject matter related to a concurrently filed U.S. Patent Application by Christy M. Woo entitled "Consistent Plating System for Electroplating". The related application is also assigned to Advanced Micro Devices, Inc. and is identified by 09/300,811.

TECHNICAL FIELD

The present invention relates generally to plating and more particularly to electro-chemical plating for semiconductor devices.

BACKGROUND ART

In the process of manufacturing integrated circuits, after the individual devices such as the transistors have been fabricated on the silicon substrate, they must be connected together to perform the desired circuit functions. This connection process is called "metalization" and is performed using a number of different photolithographic and deposition techniques. As the technology has been developing, electrochemical deposition or electroplating has become the preferred metalization process to deposit the bulk amount of conductive metal and metal alloys for interconnecting semiconductor devices.

Typically, the chemical bath used in the electroplating process is the most difficult parameter to control. To achieve successful deposition of metal into smaller and smaller, high aspect ratio features, such as semiconductor trenches or vias where the width is small compared to a large depth, different fluid additives must be added to and mixed in the plating bath to enhance the electroplating filling capability. Each plating bath is used to process in excess of 1,500 wafers per batch of plating solution. The useful life of a batch of plating solution is determined by how quickly the additives are consumed during the plating process, how quickly the additives are destroyed by oxidation during processing, or how quickly detrimental by-products from the plating process accumulate. All these factors create unstable and changing formulations of the plating bath. At the end of the useful life of the batch of plating solution, it must be disposed of and a new batch of plating solution formulated.

In the past, the plating bath control method employed by the semiconductor industry was to monitor important components on an analysis bench outside the plating equipment. For example, for copper plating, the important components for an acid copper plating bath included analysis for copper ion, sulfuric acid, hydrochloric acid, other additives, and carbon by-product level. After analysis, the desired component concentration was maintained by adding a required amount of the individual components in a predetermined amount so as to maintain the bath in a predetermined, but relatively wide, range.

The analysis of particulate and carbon by-products generally determined when the plating bath solution needed to be disposed of and a new batch formulated since there was no method of removing the carbon by-products without also removing some of the other additives. This generally resulted in the need to dispose of large volumes of environmentally unsafe fluid.

As the semiconductor industry moves into higher and higher volume production, it has become more pressing that a solution be found to provide a more environmentally friendly way of handling waste materials in semiconductor manufacturing. Further, copper is becoming more commonly used and copper is much more toxic than the aluminum which it is replacing.

DISCLOSURE OF THE INVENTION

The present invention provides an automated system for recycling the waste fluids of a semiconductor plating system in which additives to the plating solution can be controlled down to the single wafer level. The basic plating solution and all its additives are mixed in a plating solution reservoir immediately prior plating and recirculated for one semiconductor wafer. After plating, the depleted plating solution is filtered and analyzed for the amount of additive filtered out so the amount can be replenished during mixing for the next wafer.

The present invention provides a plating system where there is no variation in the plating between successive plated products. A basic plating solution and its non-degradable additives are premixed and then mixed with degradable additives in a plating solution reservoir immediately prior plating and recirculated for one semiconductor wafer. After plating, the depleted plating solution is filtered and analyzed for immediate replenishment of the non-degradable additives.

The present invention further provides a consistent and extremely tight control of component composition during plating. A basic plating solution and its non-degradable additives are premixed at a remote site. The premixed plating solution and degradable additives are mixed in a plating solution reservoir immediately prior plating and recirculated for one semiconductor wafer. After plating, the depleted plating solution is filtered and analyzed for later replenishment of the non-degradable additives at the remote site.

The present invention further eliminates the accumulation of detrimental plating by-products in a plating bath.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
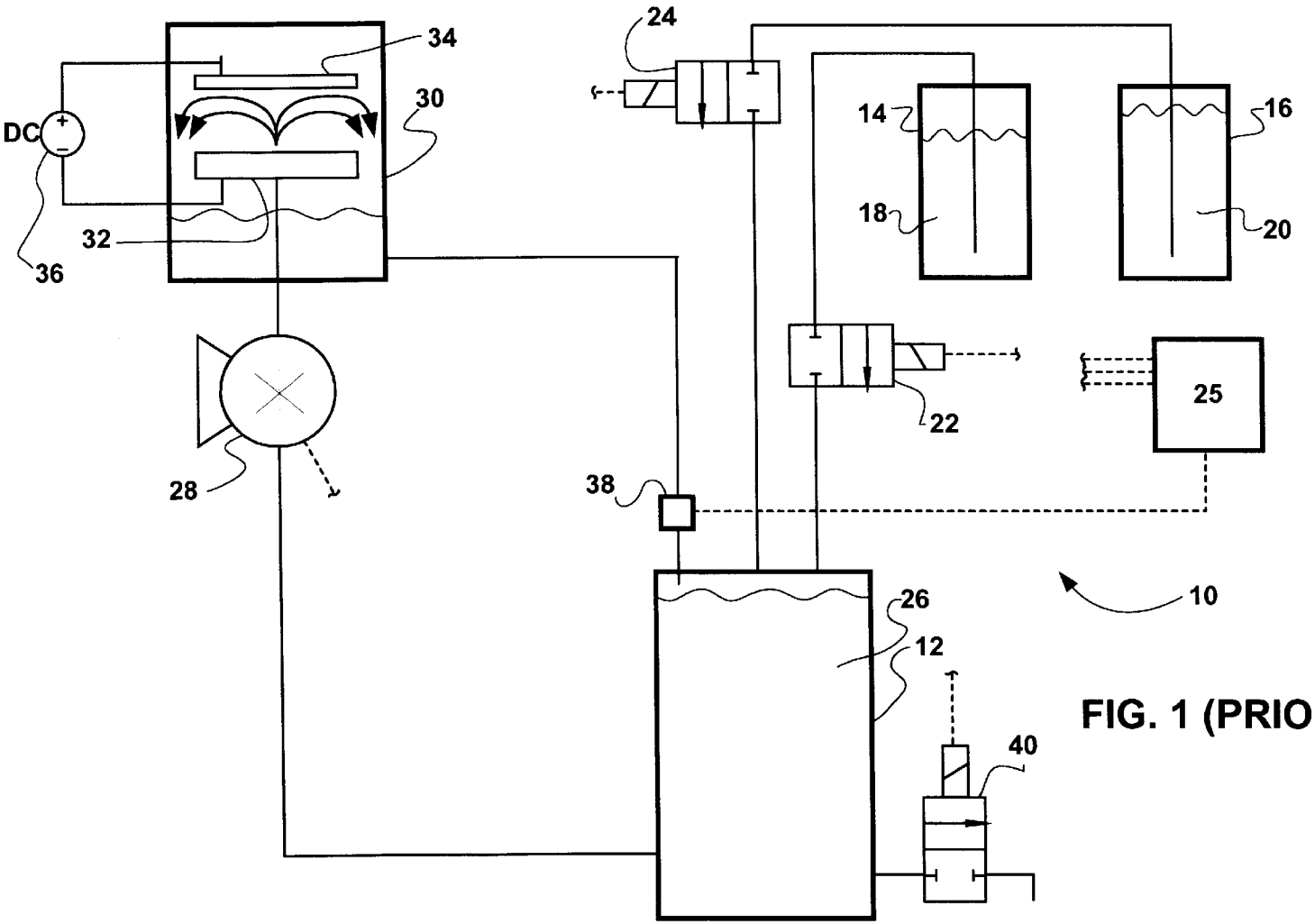
FIG. 1 (PRIOR ART)
FIG. 1 (PRIOR ART) shows a conventional electrochemical plating system.

Referring now to FIG. 1 (PRIOR ART), therein is shown a conventional electroplating system 10. The electroplating system 10 includes a plating solution tank 12 containing the mixed plating solution 26. The plating solution tank 12 has connected thereto a plurality of containers. A container 14 represents a plurality of containers which contain degradable additives 18 that degrade over time, such as by oxidation, or degrade with mixing, such as by being in contact with the plating solution. A container 16 represents a plurality of containers which contain non-degradable additives 20 which are stable over long periods of time, such as de-ionized water, sulfuric acid, hydrochloric acid, etc.

In the connection between the containers 14 and 16 are shut-off valves 22 and 24, which are generally manually controlled to allow the passage of the additives 18 and 20 into the plating solution tank 12 to be mixed with the solution therein to form the plating solution 26. The valves 22 and 24 are shown as being electrically or electronically controllable either from a remote location or by a simple processing control 25.

A recirculation mechanism, or pump 28, for pumping the plating solution 26 into a plating cell 30 connects the plating solution tank 12. The pump 28 could also be on the return side of the plating cell 74. The plating solution 26 is pumped through an anode 32 against a semiconductor wafer 34 which acts as a cathode by being connected to a power supply 36 which is also connected to the anode 32. After use, the plating solution 26 is returned past a sampling port or an analysis tool 38 to the plating solution tank 12.

Examples of the analysis tool 38 are the Dionex HPLC DX-800 from Dionex Corporation, 1228 Titan Way, Sunnyvale, Calif. 94088-3603 and the Parker System PS 2000 from Parker Systems, 2821 E. Philadelphia Avenue, Unit D, Ontario, Calif. 91761.

The plating solution tank 12 further has a drain valve 40 for emptying the plating solution tank 12 when the additives are degraded or detrimental by-products of the plating process, such as carbon, have built up to an unacceptable extent. In the past, the depleted plating solution was discarded.

Figure 2:
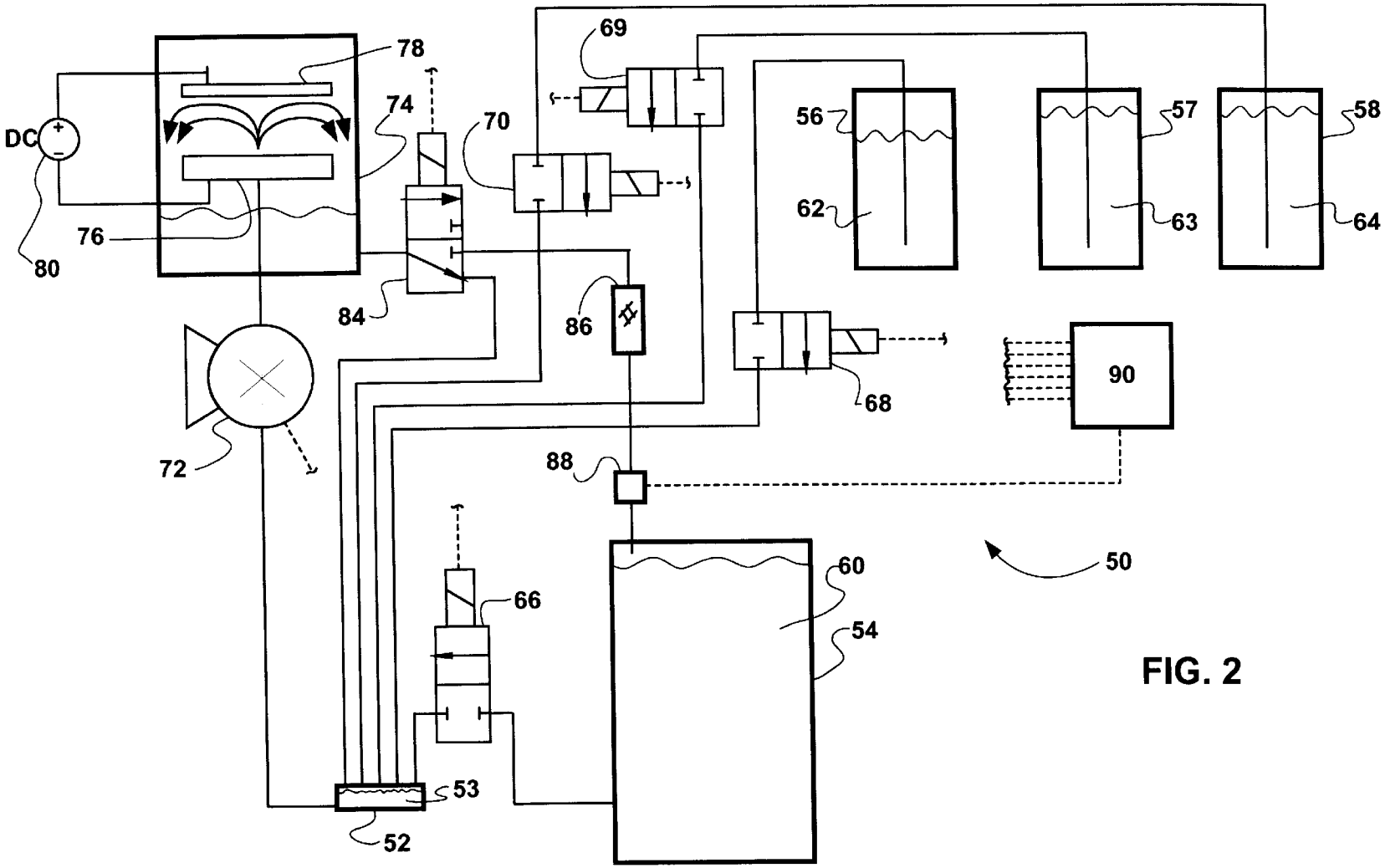
FIG. 2 shows an electro-chemical plating system according to the present invention.

Referring now to FIG. 2, therein is shown the plating system 50 of the present invention. The plating system 50 includes a plating solution reservoir 52 which is extremely small. Typically, it will contain the plating solution 53 in a volume of between 25 to 250 cubic centimeters as contrasted to the plating solution tank 12, which would contain many liters of plating solution 26.

The plating solution reservoir 52 is connected to a plurality of containers 54, 56, 57, and 58. The container 56 contains a basic plating solution 62 with no additives, while the container 57 contains a non-degradable additive 63 and the container 58 contains a degradable additive 64. The containers 56, 57, and 58 each represent a plurality of containers.

The containers 54, 56, 57, and 58 are respectively connected through shut-off valves 66, 68, 69, and 70 to the plating solution reservoir 52. The valves 66, 68, 69, and 70 are shown as being electrically or electronically controllable by a control mechanism 90, such as a computer or microprocessor. The control mechanism 90 may also be a simple timer since the "one-shot" operation of the present invention lends itself to one-time setup and continuing operation on a time basis.

A pump 72 pumps the plating solution 53 from the plating solution reservoir 52 to a plating cell 74. In the plating cell 74, the plating solution 53 is pumped through a anode 76 against a semiconductor wafer 78 which acts as a cathode by being connected to a power supply 80 which is also connected to the anode 76.

The plating cell 74 is connected by a three-way return valve 84, which returns the plating solution 53 to the plating solution reservoir 52 or sends it to a filtration unit 86 and an analysis tool 88. The filtration unit 86 is a single filter or multiple filters to remove different detrimental by-products of the particular plating process being carried out. For example, carbon is a detrimental by-product of copper plating, as are various particulates. If the filtration unit 86 is filtering out carbon, it is also likely to filter out some or all of the degradable additives. The analysis tool 88 is used to monitor the composition of the plating solution 53 after plating to determine the amount of degradable additives filtered out and provide input to the control mechanism 90 on the composition of the depleted plating solution 60 being provided to the container 54. In addition to determining the amount of degradable additives filtered out, the analysis tool 88 determines the amount of non-degradable additives depleted by the plating process. Both the additives are then replenished for the next wafer to be plated.

Figure 3:
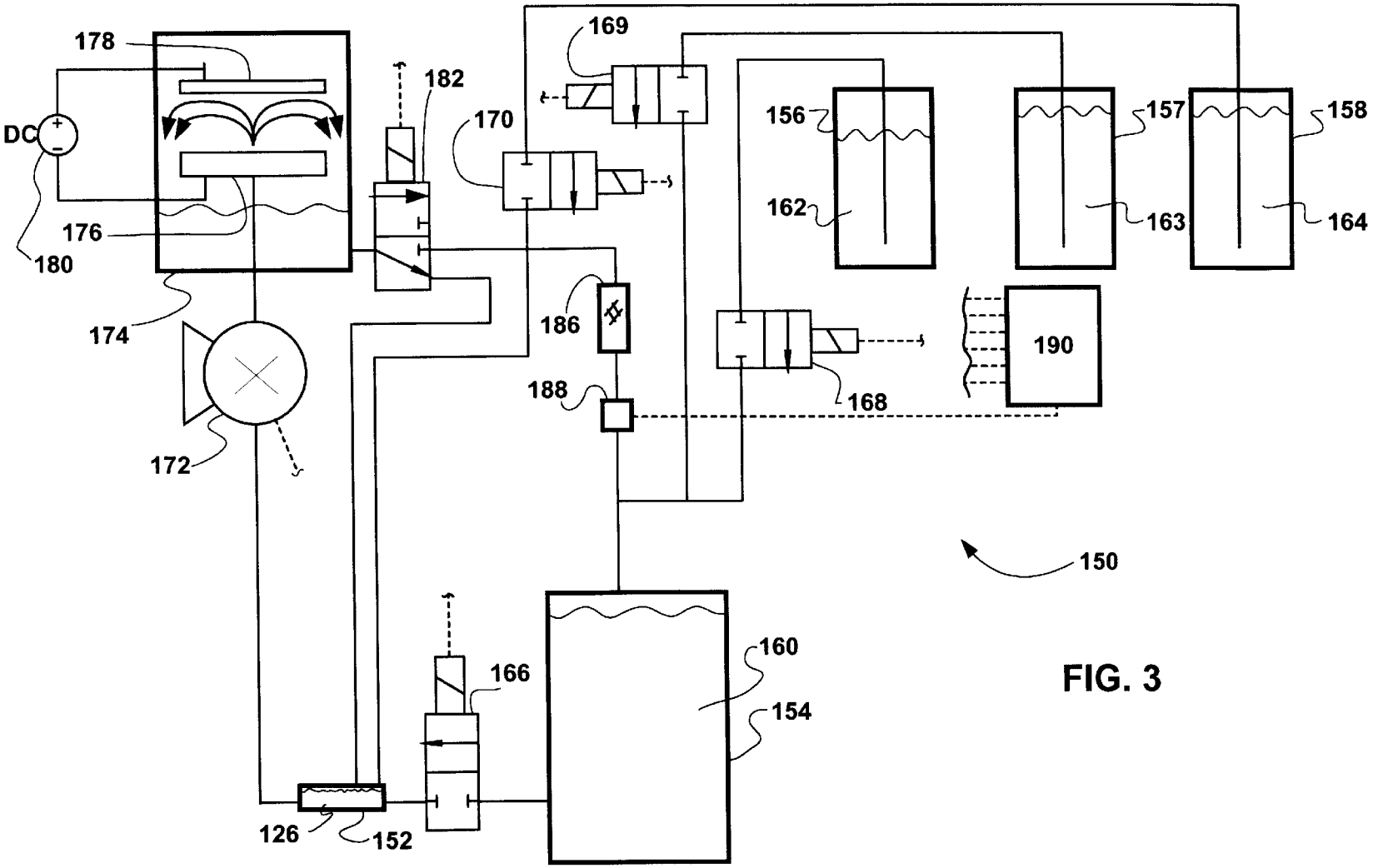
FIG. 3 shows a partial-premix electro-chemical plating system according to an alternate mode of the present invention.

Referring now to FIG. 3, therein is shown an alternate embodiment electroplating system 150 in accordance with the present invention. The electroplating system 150 includes a partially premixed plating solution tank 154 connected to a plating solution reservoir 152 and having connected thereto a plurality of containers such as containers 156 and 157. The container 156 contains the basic plating solution 162 and the container 157 contains the nondegradable additive 163. The plating solution reservoir 152 is connected to the container 158 which contains the degradable additive 164.

Shut-off valves 168 and 169 are located between the partially premixed plating solution tank 154 and containers 156 and 157. These valves 168 and 169 allow the premixing of the basic plating solution 162 and the non-degradable additive 163 to form the partially premixed plating solution 160. The partially premixed plating solution 160 passes into the plating solution reservoir 152 where it is mixed with the degradable additive 164 to form the plating solution 126. The valves 166, 168, 169, and 170 are shown as being electrically or electronically controllable either from a remote location or by a processing control 190.

A pump 172 for pumping the plating solution 126 into a plating cell 174 connects the plating solution reservoir 152. The pump 172 pumps the plating solution 126 through an anode 176 against a semiconductor wafer 178 which acts as a cathode by being connected to a power supply 180 which is also connected to the anode 176.

During plating of the single semiconductor wafer 178, a three-way return valve 182 recirculates the plating solution 126 back to the plating solution reservoir 152. The processing control 190 controls the three-way return valve 182. After use, the depleted plating solution 126 is drained through a filtration unit 186. The filtration unit 186 is a single filter or multiple filters to remove different detrimental by-products of the particular plating process being carried out. From the filtration unit 186, the filtered plating solution passes to an analysis tool 188 which operates with the processing control 190 to replenish the missing basic plating solution 162 and additive 163 in the filtered and depleted plating solution to form the partially premixed plating solution 160.

Figure 4:
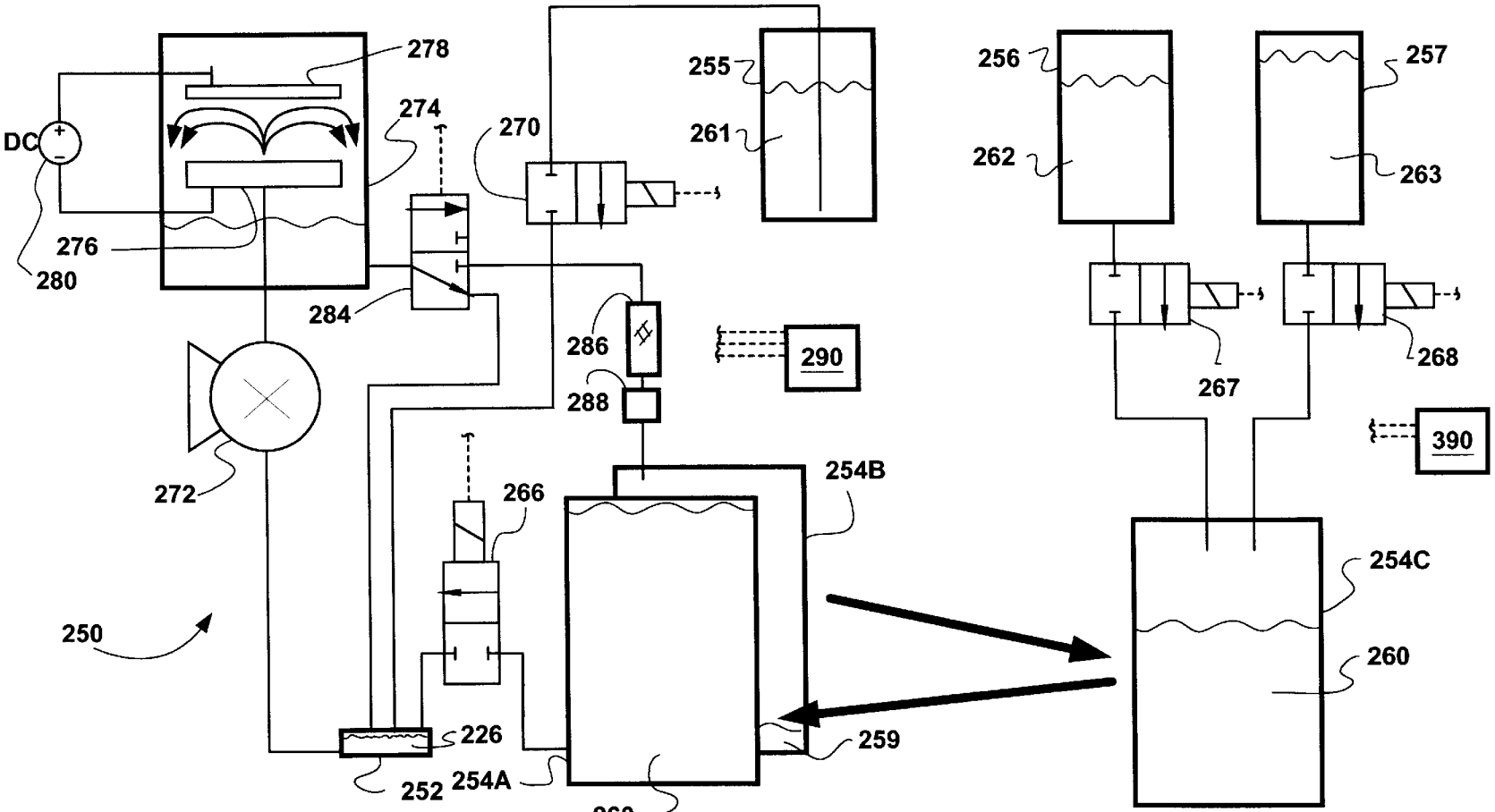
FIG. 4 shows a remote-premix electro-chemical plating system according to a further alternate mode of the present invention.

Referring now to FIG. 4, therein is shown an alternate embodiment electroplating system 250 in accordance with the present invention. The electroplating system 250 includes a plating solution reservoir 252 connectable to a replaceable, plating solution tank 254A and a degradable additive container 255. The basic plating solution tank 254A contains a partially premixed plating solution 260 which is just missing a degradable additive 261. The degradable additive container 255 contains the degradable additive 261.

In the connection between the containers 254A and 255 and the plating solution reservoir 252 are shut-off valves 266 and 270, respectively, which are electronically controlled to allow the passage of the plating solution 260 and the degradable additive 261 to be mixed to form the plating solution 226. The valves 266 and 270 are shown as being electrically or electronically controllable either from a remote location or by a processing control 290.

A pump 272 for pumping the plating solution 226 into a plating cell 274 connects the plating solution reservoir 252. The pump 272 pumps the plating solution 226 through an anode 276 against a semiconductor wafer 278 which acts as a cathode by being connected to a power supply 280 which is also connected to the anode 276.

During plating of the single semiconductor wafer 278, a three-way return valve 284 recirculates the plating solution 226 back to the plating solution reservoir 252. The processing control 290 controls the three-way return valve 284. After use, the plating solution 226 is drained through a filtration unit 286. The filtration unit 286 is a single filter or multiple filters to remove different detrimental by-products of the particular plating process being carried out. From the filtration unit 286, the filtered plating solution passes to an analysis tool 288 which develops a record of the missing additives in the filtered and depleted plating solution 259. From the analysis tool 288, the filtered and depleted solution 259 is stored in a container 254B.

When the container 254A is empty, a container 254C which is filled with the partially premixed plating solution 260 replaces it. The container 254B which is partially filled with the filtered and depleted solution 259 is taken, along with the analysis of its contents to a remote site.

At the remote site are a plurality of containers such as containers 256 and 257 for containing non-degradable additives 262 and 263, respectively. The containers 256 and 257 represent between one to ten containers, which contain such fluid additives as de-ionized water, sulfuric acid, hydrochloric acid, other additives, etc. The containers 256 and 257 are connected through shut-off valves 267 and 268, respectively, to the container 254B to be refilled. The analysis from the analysis tool 288 is used by the control 390 to provide the proper formulation for the partially premixed plating solution 260. In FIG. 4, the refilled container is designated 254C.

In the past, as shown in FIG. 1 (PRIOR ART), an entire batch of plating bath solution 26 was made up in the plating tank 12 for a "lot" of wafers. Generally, a lot would be in excess of 1500 wafers. The basic solution would be poured into the plating solution tank 12 and the additives 18 and 20 would be added and mixed by manually opening the valves 22 and 24.

The plating bath solution 26 was then pumped through the pump 28 into the plating cell 30, past the anode 32 to bathe the wafer 34. The power supply 36 would be energized and the anode 32 would charge the plating bath solution 26 and so cause electrochemical deposition of a material such as copper on the wafer 34 which acted as a cathode. After being used to plate the wafer 34, the partially depleted plating solution 26 with detrimental by-products would be recirculated back to the plating solution tank 12.

Periodically, the recirculated plating solution 26 would be sampled and the sample analyzed using other equipment. More recently, the bath analysis tools described above have been developed and a sample would be analyzed at the bath analysis tool 38. After the plating bath solution 26 reaches certain limits, the valves 22 and 24, which are electronically controllable, would be opened to add additives 18 and 20, respectively, to the plating solution tank 12.

After a large number of wafers had been plated and the chemical reactions had increased the detrimental reaction by-products to the point where the plating was about to deteriorate, the drain valve 40 would be opened to empty the plating solution tank 12. This generally resulted in large volumes of environmentally unsafe fluid needing to be disposed of.

In the present invention shown in FIG. 2, the shut-off valves 66, 68, 69, and 70 are opened and closed by the control 90 to fill the plating solution reservoir 52. This mixes a combination of the plating solution 60 and the additives 62 and 64 to make up the plating solution 53. This operation is performed immediately before use for each semiconductor wafer 78 or each small batch of wafers, such a single wafer boatload of about twenty-five wafers. The plating solution 53 would then be pumped by the pump 72 to the plating cell 74 past the anode 76 to bathe the wafer 78. The power supply 80 would charge the anode 76 so as to charge the plating solution 53 to electro-chemically deposit the plating material on the wafer 78 acting as a cathode. The plating solution 53 is circulated back to the plating solution reservoir 52 through the valve 84.

The filtration unit 86 will filter out particulates in one step and the carbon by-products in a second step from the recirculated reservoir solution 53. The filtration unit 86 may also remove desirable additives, in which case they are replenished from the containers 56, 57, or 58, as appropriate. Again, this could be achieved by determining the desired composition and setting the valve timers. This would allow virtually unlimited recycling of the basic plating solution 60 along with many of the additives.

The filtration unit would have to be cleaned periodically, but systems for backflushing filtration units for cleaning are well known in the art.

The cycling for each wafer could be performed by a control mechanism 90 which is a computer, microprocessor, or microcontroller; however, in the best mode, the optimal combination of plating solution is determined just once and simple timers could be used to sequence all the cycles.

It would be understood by those skilled in the art that the plating system 50 can be used to provide exactly repeatable processing of each wafer for an unlimited number of wafers.

In the alternate mode of FIG. 3, the partially premixed plating solution 160 contains the basic plating solution 162 and the non-degradable additive 163. Immediately before plating, the partially premixed plating solution 160 and the degradable additive 164 is are mixed in the plating solution reservoir. Sufficient plating solution 126 is mixed for a single wafer 178 and circulated until plating is completed. Then, the three-way return valve 182 is selected to connect the depleted plating solution to the filtration unit 186. The analysis tool 188 is used to provide input to the control 190 to operate the shut-off valves 166, 168, 169, and 170 as well as the pump 172.

This system 150 also provides a completely automated system for many different types of wafers and assures absolutely repeatable results. However, it should be understood that the present invention can be practiced least expensively merely using timer controlled shut-off valves 166, 168, 169, and 170 and a timer controlled pump 172. This is because it is possible to run one test wafer 178, analyze the impact on the plating solution 126, and calculate the proper timing sequence. That sequence could be for each subsequent wafer and achieve the same processing on each of the subsequent wafers.

In the alternate mode shown in FIG. 4, the control 290 activates the valves 266 and 270 to mix the partially premixed plating solution 260 and the degradable additive 261 in the plating solution reservoir 252. The plating bath solution 226 is then pumped through the pump 272 into the plating cell 274, past the anode 276 to bathe the wafer 278. The power supply 280 is energized and the anode 276 charges the plating solution 226 and so causes electrochemical deposition of a material such as copper on the wafer 278 which acts as a cathode.

The three-way return valve 284 is selected by the control 290 to recirculate the plating solution 226 until a wafer 278 is plated. After plating, the three-way return valve 284 is selected to send the depleted plating solution 226 with its detrimental by-products through the filtration unit 286. The filtration unit 286 will filter out particulates in one step and the carbon by-products in another step. The filtration unit 286 also removes degradable additives.

The analyzer tool 288 then takes the filtered and depleted plating solution 259, and analyzes it and provides a record of its composition. When the container 254A is empty, the container 254C, filled with premixed plating solution 260, replaces it. The container 254B with the filtered and depleted plating solution 259 replaces the container 254C. The record of the composition of the filtered and depleted plating solution 259 is provided to the processing control 390 which opens the shut-off valves 267 and 268 to respectively replenish the missing the non-degradable additives 262 and 263 from the respective containers 256 and 257.

While the replenishment activity could be at a remote site on the premises of the semiconductor manufacturing plant, it could also be at a separate chemical supply vendor's facility or a separate recycling plant.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

The invention claimed is:

1. A plating system for plating objects comprising:

a plating solution container capable of containing plating solution;

an additive container capable of containing an additive for the plating solution;

a plating solution reservoir connected to said plating solution container and said additive container, said plating solution reservoir for mixing plating solution with the additive;

a plating cell connected to said plating solution reservoir and capable of containing an object to be plated, said plating cell capable of having the object bathed in the plating solution;

a filtration unit connected said plating cell;

a return valve connected to said plating cell for selectively connecting said plating cell to said plating solution reservoir and to said filtration unit; and an additive valve disposed between said additive container and said plating solution reservoir for controlling the flow of additive therebetween.

2. The plating system as claimed in claim 1 wherein:

said filtration unit removes the additive from the plating solution and provides the filtered plating solution to said plating solution container; and said additive valve is operative to cause the additive from said additive container to be made up in said plating solution reservoir.

3. The plating system as claimed in claim 1 including:

an analysis tool connected to said filtration unit for analyzing the composition of the filtered plating solution.

4. The plating system as claimed in claim 1 wherein:

said additive container is connected to said plating solution container to mix with plating solution therein.

5. The plating system as claimed in claim 1 including:

a pump for circulating the plating solution between said plating cell and said plating solution reservoir; and a control connected to said return valve, said additive valve, and said pump for controlling the mixing of the plating solution and the additive, said control for controlling the pumping of the plating solution to bathe the object, and said control for selectively controlling the return of the plating solution from said plating cell to said plating solution reservoir during plating and to said plating solution container after plating.

6. The plating system as claimed in claim 5 wherein said control includes a timer.

7. The plating system as claimed in claim 5 wherein said control is computerized.

8. The plating system as claimed in claim 5 wherein:

said additive container is capable of containing a degradable additive;

and including:

an additional additive container capable of containing a non-degradable additive;

an additional additive valve connecting said additional additive container to said plating solution container.

9. The plating system as claimed in claim 5 wherein:

said additive container is capable of containing a degradable additive;

and including:

an additional additive container capable of containing a non-degradable additive, said additional additive container located at a remote site from said plating solution reservoir;

an additional plating solution container connectable to said additional additive container;

an additional additive valve connecting said additional additive container to said additional plating solution container, said additional additive valve located at a remote site from said plating solution reservoir.

10. A semiconductor wafer plating system comprising:

a plating solution container capable of containing plating solution;

an additive container capable of containing an additive for the plating solution;

a plating solution reservoir connected to said plating solution container and said additive container, said plating solution reservoir for containing plating solution formed from the plating solution mixed with the additive, said plating solution reservoir capable of containing sufficient plating solution for a single wafer;

a plating cell capable of containing a single wafer to be plated and capable of having the single wafer bathed with plating solution from said plating solution reservoir;

a filtration unit connected to said plating cell;

a return valve connected to said plating cell operable to connect said plating cell to said plating solution reservoir for controlling the flow of plating solution therebetween and through said filtration unit to said plating solution container; and an additive valve disposed between said additive container and said plating solution reservoir for metering the flow of additive therebetween.

11. The plating system as claimed in claim 10 wherein:

said filtration unit removes the additive from the filtered plating solution;

an analysis tool is connected to said filtration unit for analyzing the composition of the filtered plating solution and determining the amount of additive filtered therefrom; and said additive valve is operative to cause said additive from said additive container to add the amount of additive to replace the amount of additive filtered from the filtered plating solution.

12. The plating system as claimed in claim 10 including:

a plating solution valve for controlling the flow of plating solution from said plating solution container to said plating solution reservoir;

a control for controlling said return, additive, and plating solution valves; and an analysis tool connected to filtration unit and said control for analyzing the filtered plating solution and causing said control to control the plating of the wafer.

13. The plating system as claimed in claim 10 wherein:

said filtration unit removes the additive from the plating solution, and said additive valve is operative to cause the additive from said additive container to be made up in said plating solution reservoir.

14. The plating system as claimed in claim 10 including:

a pump for pumping the plating solution between said plating solution reservoir and said plating cell;

a control connected to said valves and to said pump for controlling the mixing and pumping of the plating solution, said control for controlling the return of the plating solution from said plating cell; said control returning the plating solution to said plating cell while the single wafer is being plated and draining the plating solution after the single wafer is plated; and said plating solution reservoir capable of having said basic plating solution and said additive mix therein.

15. The plating system as claimed in claim 14 wherein said control includes a timer whereby said valves and pump are time controlled.

16. The plating system as claimed in claim 14 wherein said control mechanism includes an analysis tool and is responsive thereto to cause said control mechanism to maintain a precise composition of the plating solution.

17. The plating system as claimed in claim 14 wherein said control mechanism includes a microcontroller.

18. A plating system for plating semiconductor wafers comprising:

a plating solution container capable of containing a basic plating solution;

an additive container capable of containing a degradable additive for the basic plating solution;

an additional additive container capable of containing a non-degradable additive for the basic plating solution;

a plating solution reservoir connected to said plating solution container, said additive container, and said additional additive container;

said plating solution reservoir for containing the plating solution formed from the basic plating solution mixing with the degradable and non-degradable additives;

a plating cell capable of containing a single semiconductor wafer to be plated; and a pump connected to said plating solution reservoir capable of pumping the plating solution into said plating cell to bathe said single semiconductor wafer;

a filtration unit disposed between said plating cell and said plating solution reservoir to remove detrimental by-products from the plating solution and wherein said filtration unit removes the additive from the plating solution;

a plating solution valve to control flow from said plating solution container to said plating solution reservoir;

an additive valve to control flow from said additive container to said plating solution reservoir;

additional additive valve to control flow from said additional additive container to said plating solution reservoir;

a return valve for selectively connecting said plating cell to said plating solution reservoir and through said filtration unit to said plating solution container; and a control for causing said pump to bathe the wafer with the plating solution while said return valve connects said plating cell to said plating solution reservoir and for causing said plating solution, additive, and additional additive valves to connect said plating solution, additive, and additional additive containers to said plating solution reservoir while said return valve connects said plating cell to said plating solution container.

19. A plating system for plating semiconductor wafers comprising:

a plating solution container capable of containing a partially premixed plating solution;

an additive container capable of containing a degradable additive for the partially premixed plating solution;

an additional additive container capable of containing a non-degradable additive for the partially premixed plating solution;

a plating solution reservoir connected to said plating solution container and said additive container;

said plating solution reservoir for containing the plating solution formed from the partially premixed plating solution mixing with the degradable additive;

a plating cell capable of containing a single semiconductor wafer to be plated; and a pump connected to said plating solution reservoir capable of pumping the plating solution into said plating cell to bathe said single semiconductor wafer;

a filtration unit disposed between said plating cell and said plating solution container to remove detrimental by-products from the plating solution from said plating cell and wherein said filtration unit removes the degradable additive from the plating solution;

a plating solution valve to control flow from said plating solution container to said plating solution reservoir;

an additive valve to control flow from said additive container to said plating solution reservoir;

an additional additive valve to control flow from said additional additive container to said plating solution container;

a return valve for selectively connecting said plating cell to said plating solution reservoir and through said filtration unit to said plating solution container; and a control for causing said pump to bathe the wafer with the plating solution while said return valve connects said plating cell to said plating solution reservoir and for causing said plating solution and additive valves to connect said plating solution and additive containers to said plating solution reservoir while said return valve connects said plating cell to said plating solution container.

20. A plating system for plating semiconductor wafers comprising:

a plating solution container capable of containing a partially premixed plating solution;

an additive container capable of containing a degradable additive for the partially premixed plating solution;

an additional additive container at a remote location capable of containing a non-degradable additive for the partially premixed plating solution;

a plating solution reservoir connected to said plating solution container and said additive container;

said plating solution reservoir for containing the plating solution formed from the partially premixed plating solution mixing with the degradable additive;

a plating cell capable of containing a single semiconductor wafer to be plated; and a pump connected to said plating solution reservoir capable of pumping the plating solution into said plating cell to bathe said single semiconductor wafer;

a filtration unit disposed between said plating cell and said plating solution container to remove detrimental by-products from the plating solution from said plating cell and wherein said filtration unit removes the degradable additive from the plating solution;

an additional plating solution container capable of being filled with filtered plating solution and containing a partially premixed plating solution;

a plating solution valve to control flow from said plating solution container to said plating solution reservoir;

an additive valve to control flow from said additive container to said plating solution reservoir;

an additional additive valve at a remote location to control flow from said additional additive container to said additional plating solution container to form the partially premixed plating solution;

a return valve for selectively connecting said plating cell to said plating solution reservoir and through said filtration unit to said additional plating solution container to fill said additional plating solution container with filtered plating solution whereby flow from said additional additive valve forms the partially premixed plating solution; and a control for causing said pump to bathe the wafer with the plating solution while said return valve connects said plating cell to said plating solution reservoir and for causing said plating solution and additive valves to connect said plating solution and additive containers to said plating solution reservoir while said return valve connects said plating cell to said additional plating solution container.

* * * * *

UNITED STATES PATENT AND TRADEMARK OFFICE

CERTIFICATE OF CORRECTION

PATENT NO. : 6,200,436 B1
DATED : March 13, 2001
INVENTOR(S) : Christy Mei-Chu Woo It is certified that error appears in the above-identified patent and that said Letters Patent is hereby corrected as shown below:

Title page,
Item [12], delete "Mei-Chu"

Column 10,
Line 13, before "additional additive", insert -- an --

Signed and Sealed this

First Day of January, 2002

*Attest:*

*Attesting Officer*

JAMES E. ROGAN
*Director of the United States Patent and Trademark Office*